US009126203B2

(12) United States Patent
Kosovich

(10) Patent No.: US 9,126,203 B2
(45) Date of Patent: Sep. 8, 2015

(54) ROCK CRUSHING APPARATUS

(75) Inventor: John Kosovich, Auckland (NZ)

(73) Assignee: JFK EQUIPMENT LIMITED, Auckland (NZ)

( * ) Notice: Subject to any disclaimer, the term of this patent is extended or adjusted under 35 U.S.C. 154(b) by 124 days.

(21) Appl. No.: 13/704,967

(22) PCT Filed: Jun. 20, 2011

(86) PCT No.: PCT/NZ2011/000114

§ 371 (c)(1), (2), (4) Date: Dec. 17, 2012

(87) PCT Pub. No.: WO2011/159175

PCT Pub. Date: Dec. 22, 2011

(65) Prior Publication Data

US 2013/0092772 A1 Apr. 18, 2013

(30) Foreign Application Priority Data

Jun. 18, 2010 (NZ) ..... 586286

(51) Int. Cl.

| | |
|---|---|
| ***B02C 23/00*** | (2006.01) |
| ***B02C 21/00*** | (2006.01) |
| ***B02C 13/18*** | (2006.01) |
| ***B02C 13/28*** | (2006.01) |
| ***B02C 13/30*** | (2006.01) |

(52) U.S. Cl.

CPC ..... *B02C 21/00* (2013.01); *B02C 13/1807* (2013.01); *B02C 13/28* (2013.01); *B02C 13/30* (2013.01)

(58) Field of Classification Search

CPC ..... B02C 1/06; B02C 1/08; B02C 13/28; B02C 13/1807; B02C 13/1835

USPC ..... 241/152.2, 265, 275

See application file for complete search history.

(56) References Cited

U.S. PATENT DOCUMENTS 2,637,359 A * 5/1953 Taylor ..... 241/85
2,958,473 A * 11/1960 Massie ..... 241/108

(Continued)

FOREIGN PATENT DOCUMENTS

NZ 201190 * 8/1983 ..... B02C 13/28
NZ 274265 * 10/1993 ..... B02C 19/00

(Continued)

*Primary Examiner* — Shelley Self
*Assistant Examiner* — Leonel Vasquez
(74) *Attorney, Agent, or Firm* — Birch, Stewart, Kolasch & Birch, LLP

(57) ABSTRACT

The present invention relates to a rock crushing apparatus. Known apparatus operate on the distinct principles of compression crushing (compression between moving surfaces) or impact crushing (compression via high velocity rock impacting a surface). Both types of apparatus have disadvantages in the quality of the crushed product, energy inefficiency or high rotor wear rates. The apparatus (1) comprises a rotor (2) comprising a number of reciprocating (11) and fixed compression crushing elements (12, 13) to compression crush the rock between adjacent reciprocating and fixed surfaces. The positioning of these elements (11, 12, 13) within the rotor performs an arresting action on the rock to limit the maximum radial velocity (Vr) the rock attains before its ejection from the compression crushing elements (11, 12, 13) for impact crushing on an adjacent surface. In this way the disadvantages of compression and impact crushing are minimized to produce a superior product.

21 Claims, 6 Drawing Sheets

(56) References Cited

U.S. PATENT DOCUMENTS

| | | | | | |
|---|---|---|---|---|---|
| 4,061,279 | A | * | 12/1977 | Sautter | 241/86.1 |
| 4,504,020 | A | * | 3/1985 | Nishida et al. | 241/121 |
| 5,381,974 | A | * | 1/1995 | Gygi | 241/188.1 |
| 6,802,466 | B1 | * | 10/2004 | Van Der Zanden | 241/275 |
| 8,474,738 | B2 | * | 7/2013 | Virtanen | 241/187 |
| 2011/0155832 | A1 | * | 6/2011 | Van der Zanden | 241/205 |

FOREIGN PATENT DOCUMENTS

| | | | | |
|---|---|---|---|---|
| NZ | 274266 | * | 10/1993 | B02C 13/28 |
| NZ | 250027 | * | 10/1994 | B02C 13/14 |
| NZ | 299299 | * | 9/1996 | B02C 23/00 |
| NZ | 328061 | * | 6/1997 | B02C 23/00 |
| NZ | 328062 | * | 6/1997 | B02C 13/18 |
| NZ | 502725 | * | 2/2000 | B02C 13/18 |

* cited by examiner

PRIOR ART

Section A A

ROCK CRUSHING APPARATUS

This application is the National Stage under 35 USC §371 of International Application PCT/NZ2011/000114 filed on Jun. 20, 2011, which claims priority under 35 USC §119(a)-(d) of Application Number 586286 filed in New Zealand on Jun. 18, 2010.

STATEMENT OF CORRESPONDING APPLICATIONS

The present invention is based on the provisional specification filed in relation to New Zealand Patent Application No. 586286 the entire contents of which are incorporated herein.

TECHNICAL FIELD

This invention relates to a rock crushing apparatus. More particularly, this invention relates to a vertical shaft rock crushing apparatus using combined compression and impact crushing processes primarily for the production of high quality aggregates and also for other general rock crushing applications.

BACKGROUND ART

Traditionally rock crushing equipment that is used to reduce the size of high strength rock types has been manufactured in one of two different categories. These 'crushers' are categorised as either compression crushers or impact crushers. These two categories utilise two distinctly different processes to crush rock. Compression crushing physically loads rock particles between two metal surfaces, closing the gap between these surfaces during a crushing cycle and developing forces high enough to crack the trapped rock into multiple fragments. Impact crushing creates crushing forces via high velocity impacts of either metal on rock, rock on metal or rock on rock. Each method has its advantages and disadvantages. Compression crushing has the advantage of positive size reduction where the product size created is smaller than the feed size in a predetermined 'reduction ratio' which can be altered according to the 'setting' of the crushing apparatus. However, the compression crushing process indiscriminately reduces the size of all feed material and tends to produce a flaky, elongated product, which is undesirable for many applications. On the other hand impact crushing tends to discriminately crush weaker rock more and produce a more cubical shaped product which enhances the average strength of the product and is otherwise very advantageous in many applications. However, impact crushing suffers from the drawback that the size of the product is more variable and is dramatically influenced by a range of parameters. It is possible in some impact crushing situations for rock particles to pass through a crushing apparatus and emerge essentially unchanged in size. A further disadvantage of impact crushing is the high proportion of undesirable fine material produced in some applications, reducing the average value of the product. To utilise the advantages of each crushing process they are often used in conjunction with each other, where a number of compression crushing apparatuses will be used to reduce the size of the material down to the general product size range and then an impact crushing apparatus is used for the final 'shaping' and other quality improvement of the product.

There are many configurations of apparatuses in each category. Compression crushing apparatuses generally fall into two sub-categories: Jaw crushers, where the crushing surfaces are two flat plates; usually one moving and one stationary, and cone (or gyratory) crushers which utilise the layout of a gyrating cone within a stationary conical shell. The choice of compression crusher type for a particular application generally depends on the desired throughput vs. the feed size. Jaw crushing tends to be used in applications with a larger feed size at low to moderate production rates. Cone and gyratory crushing tends to be used in higher throughput applications where the feed size is smaller. Often crushing plants are constructed utilising multistage size reduction where a jaw crushing apparatus performs the initial size reduction and then cone crushing apparatuses are used for the subsequent size reduction. Both compression crushing types are generally constructed to crush hard and/or abrasive rock and both find economic use in a wide variety of rock types. Design parameters of greatest importance in both types of compression crushing apparatuses are: The maximum feed opening, the angle of the crushing surfaces relative to each other (the 'nip' angle), the setting (output size), the throw (the opening and closing movement of the crushing surfaces), and the speed. The optimum operating speed for a particular type of crushing apparatus is essentially a function of the preceding parameters. The flow of material through the crushing chamber occurs under gravitational force and is stopped (or 'arrested') during each crushing cycle. After each compression the stationary trapped rock particles accelerate under gravitational force, gaining speed downwards through the crushing chamber, until they are arrested by the next compression. Thus excessive crusher speed, which increases the number of compression cycles that the rock experiences during transit through the apparatus, actually reduces the crushing capacity by arresting the rock particles more frequently and reducing their average transit speed. In this sense compression crushing apparatus throughput is thus limited by gravity.

Impact crushing apparatuses also generally fall into two sub-categories: those where the crushing impact is created by metal components hitting rock (or vice versa), and those where the crushing impact is essentially rock hitting rock (so called 'autogenous' crushing). The choice of which type of impact crushing apparatus is used depends largely on the properties of the rock to be crushed. In abrasive rock types the autogenous crushing process is used almost exclusively, due to the uneconomic wear rates of metal components when they are subjected to high velocity, high abrasion impacts. The standard form of the autogenous impact crushing apparatus is that of a horizontal rotor, rotating on a vertical shaft, into which the rock to be crushed falls. The rock is thrown outwards by the spinning rotor under 'centrifugal' force and emerges from ports in the rotor at high speed to impinge on a bed of other rock surrounding the rotor. Such a configuration is known as a vertical shaft impactor (or VSI). The important design parameters of an autogenous VSI are; the feed opening, the rotor size and the rotation speed. The combination of rotor size and rotation speed determines the rim (or 'tip') speed of the rotor which governs the maximum level of kinetic energy available to the rock as it leaves the rotor. It is this available kinetic energy which largely controls the degree of size reduction achieved by the apparatus, and its power consumption, which is the dominant cost component in its operation. The operation of an autogenous VSI will now be described in more detail.

Referring to FIG. 1: As rock passes through the rotor at radial velocity Vr it is subjected to two perpendicular forces; centrifugal force Fr and coriolis force Ft. Centrifugal force acts in the radial direction out from the centre of rotation.

Coriolis force acts tangentially in the plane and direction of rotation. These forces are governed by the following equations:

$$Fr = \text{mass} \times (\text{rotation speed})^2 \times \text{radius}$$

$$Ft = \text{mass} \times \text{rotation speed} \times Vr \times 2$$

Thus the centrifugal force on a rock particle increases as it travels through the rotor (increasing radius) which tends to correspondingly accelerate it (that is, increase Vr exponentially). The coriolis force is proportional to Vr so as it speeds up the rock particle is subjected to more force from the surface it is travelling over. In a frictionless situation the rock would exit the rotor with Vr=Vt, (the tangential tip speed) and the coriolis force would be a maximum at the tip (the trailing edge of the port). The particle would exit the rotor at a relative angle of 45 degrees and its kinetic energy would be maximised, maximising the crushing forces available in its subsequent impact with the surrounding rock bed. In this situation the output kinetic energy of the rock particles would be exactly equal to the input rotational energy at the shaft. To describe this situation simplistically; the energy input at the shaft creates output kinetic energy that is 50% radial and 50% tangential. In a 'real world' situation where friction is involved the frictional drag created by the surface the rock is travelling over within the rotor provides a retarding force, reducing the rock's acceleration and consequently reducing the Vr it attains. In an autogenous VSI this surface is a bed of rock which builds up in the rotor, so designed to eliminate wear on the body of the rotor. Depending on the frictional characteristics of this rock bed the frictional force may limit Vr to a relatively low level as the feed rock exits the rotor. In this situation the coriolis force on the rotor tip at exit would be low, and the particles would exit the rotor more tangentially, but the kinetic energy of the exiting particle/s would be reduced. It is important to note however, that the input rotational energy at the shaft is the same as it would be in the frictionless situation. Thus, up to half the energy input at the shaft can be lost to internal friction within the rotor. This internal frictional loss provides no useful crushing action as the grinding action to which the rock particles are subjected to within the rotor only serves to create ultra-fine material, which is deleterious in most applications. Bearing in mind that autogenous VSI crushers are used primarily on abrasive rock types the designers of these crushers are forced to balance conflicting requirements: maximising Vr maximises kinetic energy output and thus overall energy efficiency, however it also increases both the coriolis force at the rotor tip and speed at which the rock particles 'skid' over the rotor tip. Thus the wear that the tip is subjected to increases dramatically with increasing Vr whereas minimising Vr decreases the tip wear but reduces the energy efficiency. Good rotor tip design is essential to control VSI operating costs and tips are made with ultra hard (tungsten carbide) inserts to give them an acceptable working life while maintaining relatively high Vr levels to improve energy efficiency. Patent No: NZ 168612 discloses the concept of an autogenous VSI while patents; NZ 201190, NZ 250027, NZ 274265, NZ 274266, NZ 299299, NZ 328061, NZ 328062 and NZ 502725 disclose various tip designs to enable rock bed creation within the rotor, with the effect being to limit Vr to acceptable levels. However, even with the benefit of these special tip designs autogenous VSI designers have been forced to limit input feed particle size dramatically to reduce coriolis force point loading and other tip impact loads.

It is an object of the present invention to address the foregoing problems or at least to provide the public with a useful choice.

All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein; this reference does not constitute an admission that any of these documents form part of the common general knowledge in the art, in New Zealand or in any other country.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps.

DISCLOSURE OF INVENTION

According to a first aspect of the present invention there is provided a rock crushing apparatus comprising:

a rotor, comprising:

a number of compression crushing elements positioned on an interior surface of the rotor wherein the rotor also comprises:

a reciprocating means configured to create a reciprocating motion to a reciprocating portion of each compression crushing element for compression crushing of the rock and wherein the reciprocating portion performs an arresting action on the rock fed into the rotor as it rotates, thereby limiting the maximum radial velocity (Vr) the rock attains in the rotor before its ejection from the compression crushing elements for impact crushing on an adjacent surface.

In this way the centrifugal and coriolis forces produced on feed material by the rotational motion of the rotor are utilised to assist the flow of material through the compression crushing elements, to reduce the power required to drive the compression crushing elements by minimising energy loss to internal friction and minimising rotor wear. In addition, the centrifugal force produced during high speed rotation of the rotor allows increased crushing capacity from small compression crushing elements.

Preferably, the compression crushing elements are jaw compression crushing elements.

Preferably, each compression crushing element also comprises a fixed portion.

More preferably, the fixed portion comprises a leading edge and a trailing edge with respect to the direction of rotation of the rotor.

Preferably, the fixed portion of each compression crushing element also comprises an adjustment means for each crusher element to control the compression crushing element setting.

Preferably, the compression crushing elements are angled with respect to the direction of rotation of the rotor.

Preferably, the compression crushing elements are oriented so that they reciprocate in the same plane as the rotation of the rotor.

Preferably, the reciprocating means is located on a trailing side of each compression crushing element with respect to a direction of rotation of the rotor.

Preferably, the reciprocating portion is driven via a sub rotor.

Preferably, the reciprocating portion is driven in a reciprocal motion by direct contact with a surface surrounding and external to the rotor.

Preferably, the reciprocating portion of each compression crushing element is orientated so that it is subjected to a reactive force from the rock flowing through the rotor to reduce the load on the compression crushing drive mechanism and thus improve the overall energy efficiency of the apparatus.

In this way the reciprocating portion of each compression crushing element utilises a portion of the kinetic energy of the rock within the rotor. If the reciprocating portion is on the trailing side of the rotor as it rotates it is subjected to a coriolis force reaction; if the reciprocating portion is orientated so that a centrifugal force acts on it, it is subjected to a centrifugal force reaction.

Preferably, there is an even number of alternating reciprocating portion and fixed portion of compression crushing element equally spaced around a periphery of the rotor.

More preferably, rock passing between a channel formed between adjacent fixed portion and reciprocating portion is compression crushed.

Preferably, the compression crushing elements are positioned in pairs diametrically opposed to the other pair member and timed to reciprocate identically to each other. In this way, rotor balance is maintained during operation of the rock crushing apparatus.

More preferably, the crushing action of each pair of compression crushing elements is timed differently from the others so as to even the loading on the compression crushing drive mechanism.

Preferably, the rotor is configured to allow it to perform its crushing action while being driven in either direction of rotation.

Preferably, the adjacent surface is a rock bed surrounding the rotor.

Preferably, the crushing apparatus also comprises a rotor drive taking power from an attached power source, to create rotational motion of the rotor up to the desired, tip speed.

Preferably, the crushing apparatus also comprises a compression crushing drive mechanism, comprising:

- a power supply means, configured to provide power to the reciprocating means, so that the reciprocation of each compression crushing element can be created at a frequency independent of the rotor speed; and
- a coupling to enable the rotor drive to take power from the compression crushing drive mechanism enabling the crushing apparatus to be driven from a single power source if required.

The power from the power supply means can be provided via either rotational or linear motion to the reciprocating means.

Preferably, the crushing apparatus also comprises an attaching means configured to attach the rotor to the rotor drive so that the rotor may be easily removed for maintenance.

Preferably, the rotor, rotor drive and compression crushing drive mechanism are configured so that the rock crushing apparatus performs identically when rotated in either direction.

In this way, the life of the crushing wear parts of the rock crushing apparatus are maximised without them having to be physically rotated or repositioned over time.

BRIEF DESCRIPTION OF DRAWINGS

Further aspects of the present invention will become apparent from the following description which is given by way of example only and with reference to the accompanying drawings in which.

BEST MODES FOR CARRYING OUT THE INVENTION

In a preferred form of the invention a rock crushing apparatus is now described in relation to FIGS. 2 to 6.

Figure 1:
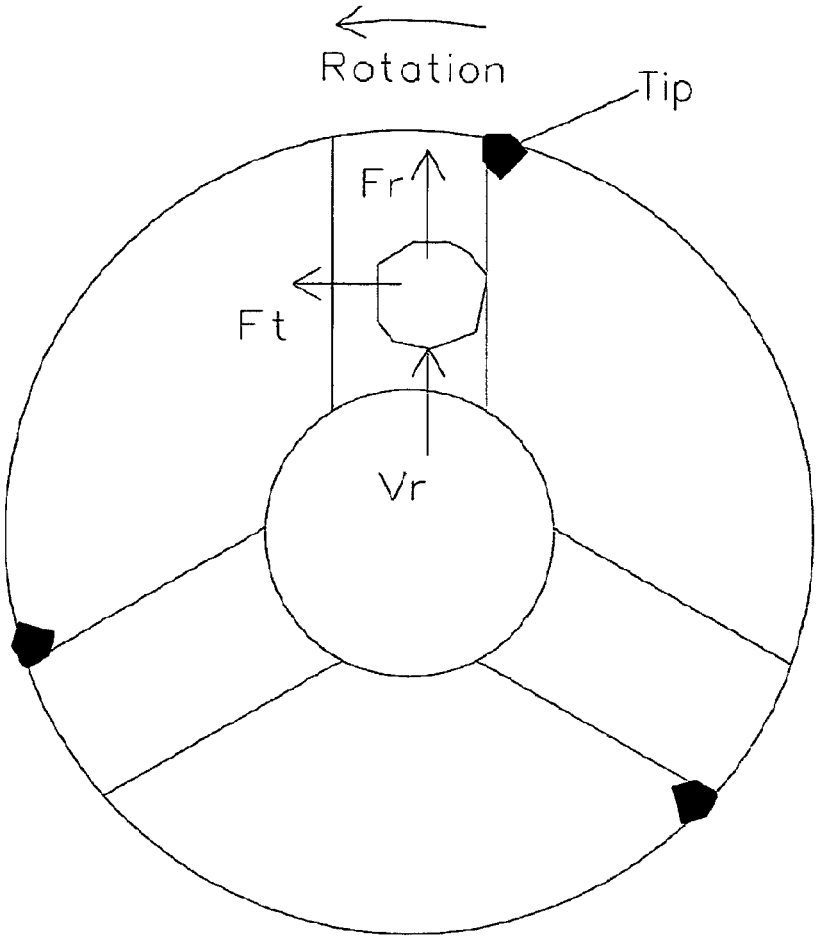
FIG. 1 shows a plan sectional view of the rotor of a known (prior art) Vertical Shaft Impactor rock crushing apparatus.
Figure 2:
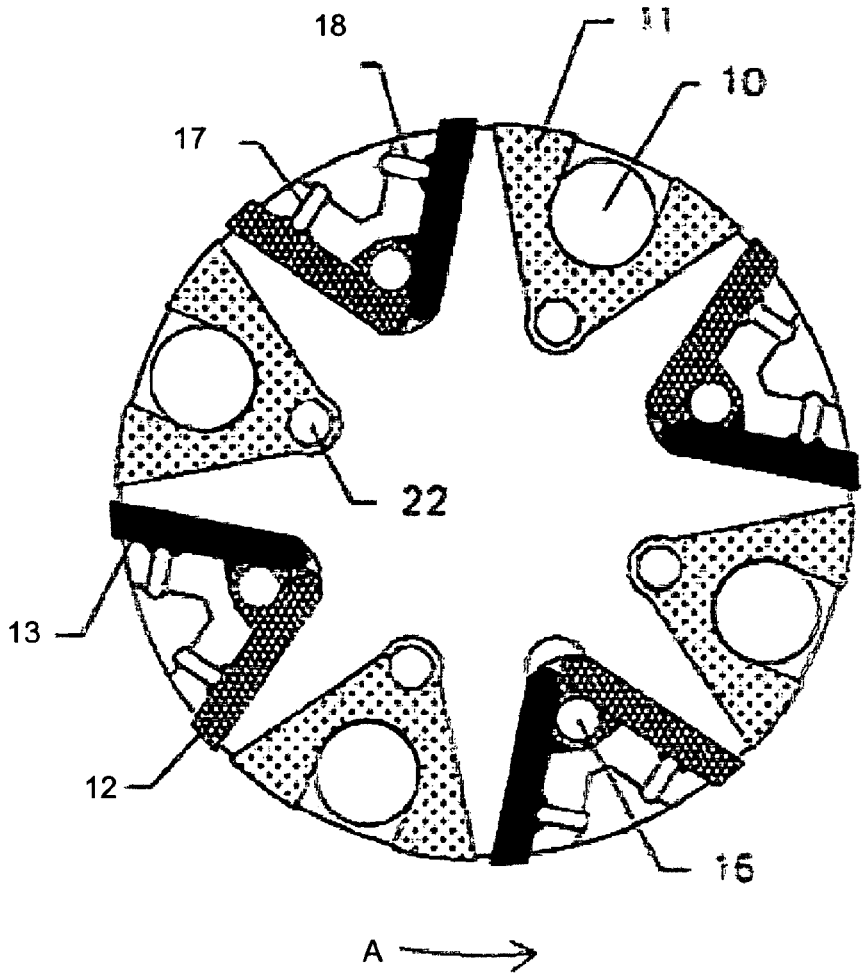
FIG. 2 shows a plan sectional view of the rotor of a preferred embodiment of the present invention in the form of a rock crushing apparatus.
Figure 3:
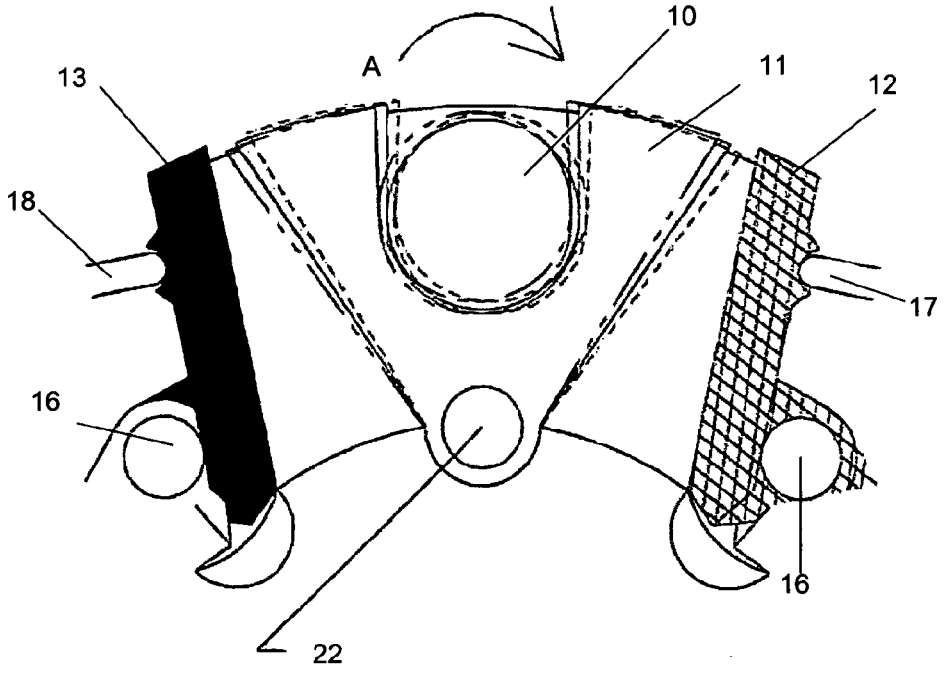
FIG. 3 shows a partial plan sectional view of the preferred embodiment shown in FIG. 2 showing the crushing motion of one of the compression crushing elements of the rotor.
Figure 4A:
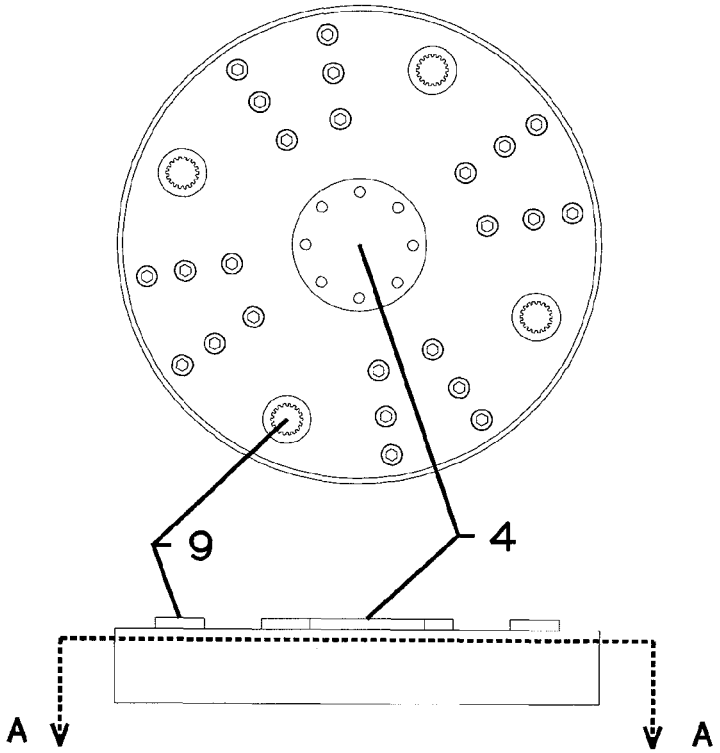
FIG. 4*a* shows a plan view of one embodiment of the compression crushing drive mechanism in the form of a sub rotor.
Figure 4B:
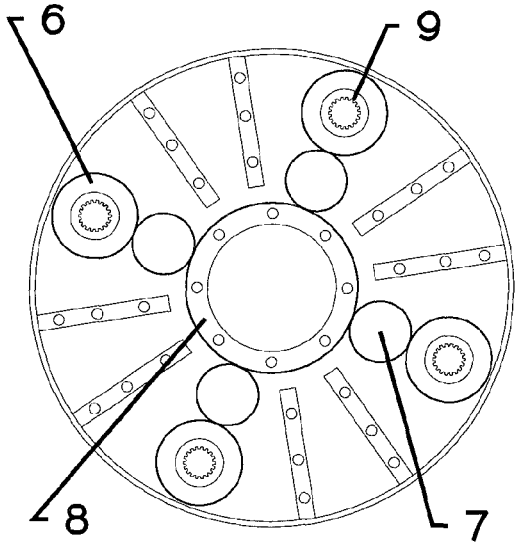
FIG. 4*b* shows a plan sectional view of the preferred embodiment shown in FIG. 4*a;*
Figure 5:
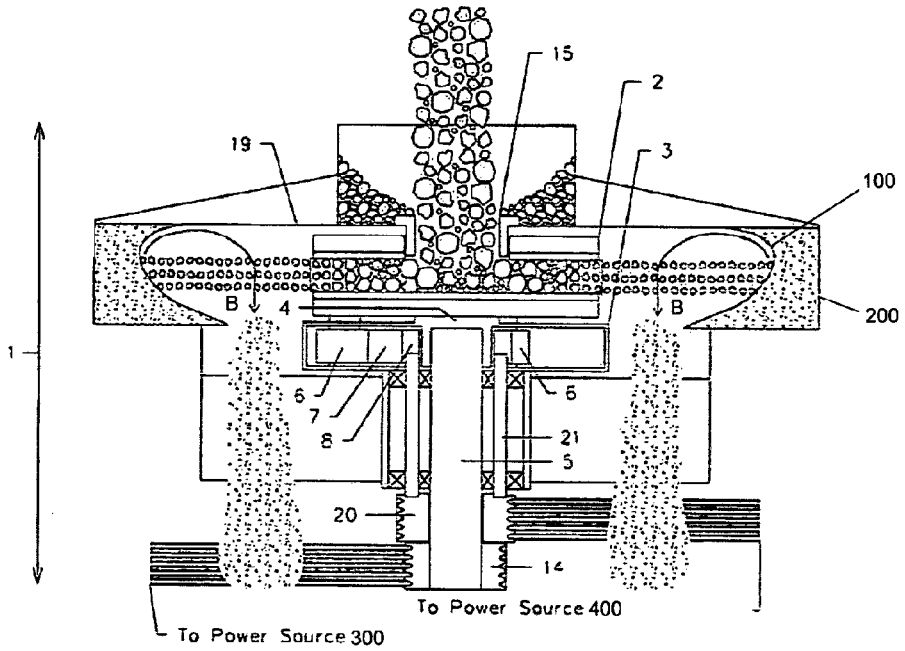
FIG. 5 shows a side sectional view of the preferred embodiment of the rock crushing apparatus during operation.
Figure 6:
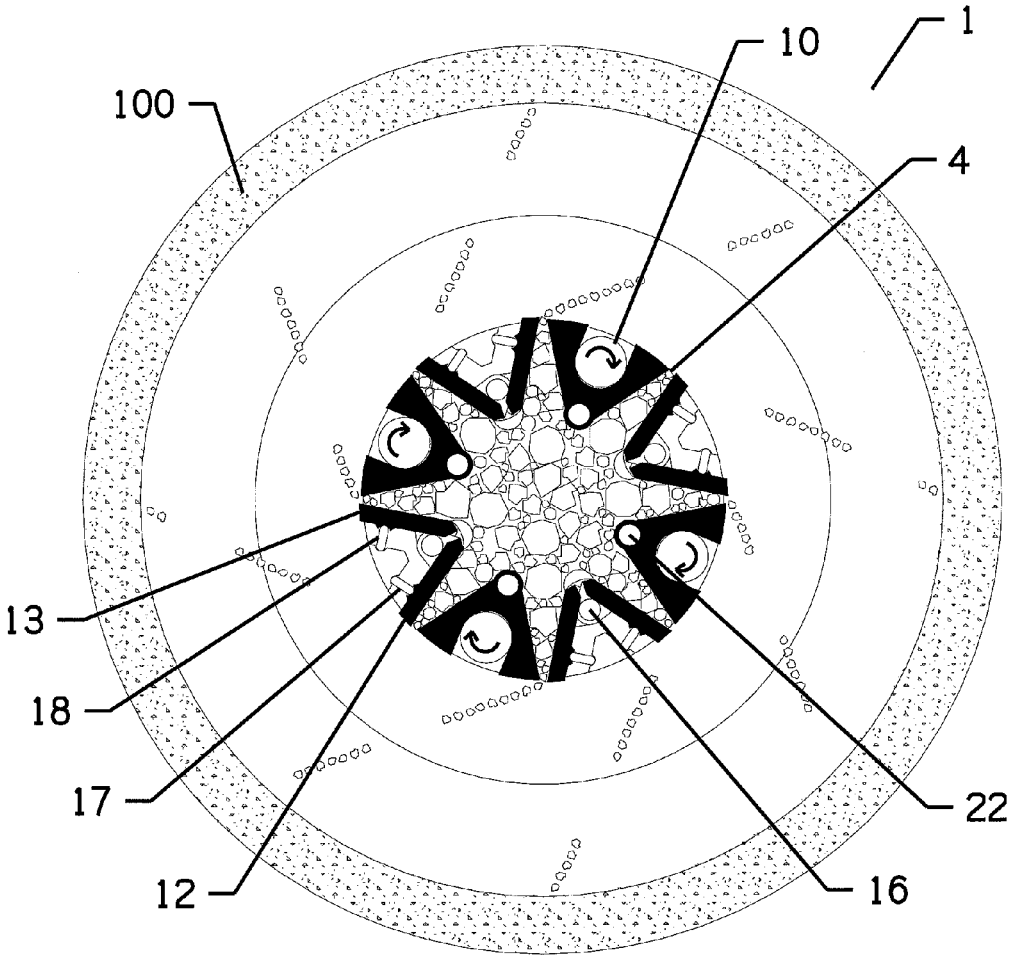
FIG. 6 shows a plan sectional view of the preferred embodiment shown in FIG. 5.

A rock crushing apparatus is generally indicated by arrow (1) in FIGS. 5 and 6. A rotor (2) is mounted on top of a sub rotor (3) via a mounting arrangement? (4) (best seen in FIG. 4*a*). Both the rotor (2) and sub rotor (3) are mounted on the main shaft (5) of the apparatus (1) and spin together at the same rotational speed. However, there is a compression crushing gear drive mechanism (6),(7),(8) within the sub rotor (3) (FIG. 4*b*) which rotates the four couplings (9) (as shown in FIGS. 4*a* and 4*b*) protruding from the top of the sub rotor (3) at an independent rotation speed. This (coupling) rotation speed is either a fixed multiple of the rotor (2) speed, adjusted in steps by the sub rotor (3) gear ratio used, or a completely independent variable speed, as described later. The couplings (9) are engaged (in a predetermined manner) with the four eccentric shafts (10) (as shown in FIG. 2) within the rotor (2) (as shown in FIG. 2). Eccentric shafts (10) utilise bearings to efficiently create a reciprocating motion of a reciprocating means in the form of the compression crushing element (11) moving jaws about their pivot pins (22) in known fashion. Compression crushing elements also include fixed jaws (12), (13) against which rock particles passing through the compression crushing element (11) are crushed. Four sets of reciprocating (11) and fixed (12), (13) compression crushing elements are spaced evenly around a peripheral surface of the circumference of the rotor (2) to form four pairs of diametrically opposed compression crushing elements. Thus the spinning of the rotor (2) and sub rotor (3) assembly creates a timed reciprocation of the crushing elements (11) with diametrically opposed (11) elements reciprocating identically (as indicated by arrows on compression crushing elements (10) in FIG. 6). The whole assembly is driven from power source (300) via the main drive pulley (14) mounted on the main shaft (5) of the apparatus (as shown in FIG. 5).

In use, once the rotor (2) is spinning at the desired tip speed and the compression crushing elements (10)-(13) are reciprocating at the desired frequency crushing is commenced by rock being fed into the rotor (2) via the feed chute (15). This feed rock is quickly brought up the rotational speed of the rotor (2) by contact with the bed of rock that builds up on the rotor's (2) bottom internal surface. Once the feed rock has gained rotational speed it is thrown outwards by centrifugal force into the compression crushing elements (10)-(13) which crush it, at high frequency, down to their set output size in known fashion. The crushed rock is then released from the individual crushing elements (10)-(13) in diametrically opposed pairs at low radial. velocity (Vr), and then thrown outwards to impinge on the adjacent surface (100) of the bed of rock (200) surrounding the rotor (2) (best seen in FIGS. 5 and 6). The subsequent impact with the rock bed (200) further crushes, shapes and improves the product rock in known fashion. The product rock then falls downwards (in the direction of arrows B in FIG. 5) and out of the apparatus (1) to be conveyed away.

Referring to FIG. 2 the compression crushing elements (10)-(13) are periodically adjusted by an adjustment means in the form of pivoting the fixed jaws (12), (13) about their pivot pins (16) and placing appropriately sized adjustment links (17), (18) behind the jaws. These adjustments are performed through an inspection door in the apparatus body (not shown) in known fashion. A person skilled in the art will appreciate that there are other forms of adjustment of the relative position of the fixed jaws (12) (13) without departing from the scope of the present invention.

The rock crushing apparatus (1) will perform identically when driven in either direction. So if power source (300) is of a type which is bi-directional (of which there are many-examples) the apparatus can be run in one direction until the wear limits of the trailing fixed jaws (12) are approached and then the apparatus can be restarted in the opposite direction and reused until the leading fixed jaws (13) are at their wear limits.

It should be noted that other embodiments of the apparatus (1) may be uni-directional in its direction of rotation as described below without departing from the scope of the present invention.

It can be shown that the reciprocating components of the apparatus (1) 'extract' work by utilising kinetic energy from the feed rock in its passage through the compression crushing elements (10)-(13). The basic principle governing this available work is as follows: When a mass (i.e. a rock particle) is rotating at a constant angular velocity, and at a constant radius of rotation, no energy is required to maintain its motion. However, as that mass moves outwards to a different radius of rotation, work is required to be performed on the mass to maintain its angular velocity. This work is provided by the coriolis force and manifests itself as increased kinetic energy of the mass due to its increased tangential velocity (Vt) plus either additional kinetic energy due to an acquired radial velocity (Vr) or the equivalent amount of work (=centrifugal force x increase in radius). Applying this principle to the compression crushing elements (10)-(13) gives the following: Rock being crushed maintains its radius of rotation and thus requires no work input to maintain its motion (it requires work for the crushing process, but that is a separate issue). However, rock moving outwards within a crushing element (10)-(13) after a compression cycle requires a work input from the rotor via the coriolis force. Some of this input work (i.e. the centrifugal force×increased radius component) can be extracted by the moving component of the crushing element (11). As the compression crushing elements (10)-(13) are all driven together by a common power source (or sources) work extracted by one element (10)-(13) can be applied to assist the (crushing) motion of another element (10)-(13). So the process is essentially one where the rotor (2) performs work on the rock which simultaneously performs work 'back' on the crushing mechanism. This work done by the rock reduces the power required to drive the apparatus (1). The work extracted is due to the action of both centrifugal and coriolis forces and is maximised if the reciprocating component (11) is on the trailing side with respect to the direction of rotation of the rotor (2). Angling of the crushing elements (10)-(13) in the plane of rotation also improves the ratio of extracted work to frictional losses. Major design considerations are described below.

Note that it is not possible to have the bi-directional property referred to above and also to have the 'optimum' configuration for energy 'extraction' so in certain situations the bidirectional configuration will be 'preferred' and in other situations the optimum energy extraction configuration will be 'preferred' or the configuration is such that it is bi-directional and still extracts a portion of the kinetic energy of the rock within the rotor (2).

When the jaws (11), (12), (13) require replacement this will most likely require a partial disassembly of the rock crushing apparatus (1) (i.e. removal of the feed chute (15) and top cover (19)) in most embodiments. However the apparatus can be configured to allow quick removal of the rotor (2) and its replacement with a pre-serviced one, without disturbing the sub rotor (3) or rotor drive (5), (14). The worn rotor (2) can then be reconditioned for reuse while the apparatus is running with the replacement rotor (2) in known fashion.

It will be appreciated by those skilled in the art that other internal arrangements of the crushing elements (10)-(13) may be used without departing from the scope of the present invention.

Compression crushing element (10)-(13) options also include (but are not limited to):

1. One driven jaw, one fixed jaw per element (10)-(13), the driven jaw on the trailing side.
2. One driven jaw, one fixed jaw per element (10)-(13), the driven jaw on the leading side of the element.
3. Two driven jaws per element (10)-(13), one leading, one trailing.
4. One driven jaw, one fixed jaw per element (10)-(13), the driven jaw on the top side of the element (10)-(13) (reciprocating essentially perpendicular to the plane of rotation).
5. One driven jaw, one fixed jaw per element (10)-(13), the driven jaw on the bottom side of the element (10)-(13). (reciprocating essentially perpendicular to the plane of rotation).
6. Two driven jaws per element (10)-(13), one top side, one bottom side.

Compression crushing elements (10)-(13) may be oriented perpendicularly, or at an angle to the direction of rotation and/or the plane of rotation.

Compression crushing elements may also be mini cone crushers as known in the art.

Each configuration may have advantages or disadvantages with respect to the following variables:

1. Throughput capacity.
2. Power consumption.
3. Wear parts consumption.
4. Acceptable feed size.
5. Reduction Ratio.
6. Compression crushing drive mechanism layout and construction.
7. Construction cost.
8. Maintenance cost.
9. Service interval.
10. Product specification.

Which configuration is used depends on the specific requirements for a particular application.

Referring again to FIG. 5 it may be desirable in some situations to use a second power source (400), in addition to the first, to drive the apparatus. This second power source (400) can be used in one of three ways:

1. It may be used to 'balance' the load on the main shaft (5) of the apparatus (1) to reduce shaft and bearing loads in known fashion.
2. It may be used to provide extra power to cover the wide range of power requirements of the apparatus (1) over its full range of rotor (2) speeds and compression crushing element (11)-(13) settings. This is likely to be a more energy efficient arrangement than using a single large power source partly loaded over much of its operation.
3. Most importantly, it may be used to independently drive the sub rotor (3) sun gear (8) via a rotor drive in the form of a separate pulley (20) and hollow drive shaft (21) (as shown in FIG. 5), concentric to the main shaft (5), to provide a fully adjustable compression crushing frequency, adjustable under load and independent of the rotor (2) speed. If used in this mode it can also provide the benefits listed in points 1 and 2 above.

In use the apparatus is assembled for crushing by the following method steps:.

a. Assembling the rotor drive (comprising (5), (14) and (20),(21) if used) into the main frame;
b. Fitting the Sub Rotor (3) to the rotor drive (5), (14);
c. Assembling the compression crushing gear drive mechanism (6)-(9) into the sub rotor(3), and 'timing' its operation to drive the compression crushing elements (10)-(13) in the pre-described sequence;
d. Assembling the compression crushing elements (10)-(13), (16)-(18), (22) into the rotor (2);
e. (optionally) Fitting the Rotor (2) to the Sub Rotor (3), via an attachment means in the form of a mounting flange (4) simultaneously connecting the compression crushing drive mechanism (6)-(9) via the couplings (9);
f. Adjusting the setting of the compression crushing elements (10)-(13) using adjusting links (17),(18);
g. Fitting the top cover (19), feed chute (15), power source (s) (300, 400) and other ancillaries to the apparatus;
h. Applying power to power source (300) and, if required, to power source (400), to bring the rotor (2) up the desired tip speed and the reciprocating compression crushing element (11) up to the desired frequency; and
i. Feeding the material to be crushed into the apparatus (1).

Preferred embodiments of the present invention may have a number of advantages over the prior art which can include:

Combined compression and impact crushing performing positive size reduction, discriminate crushing of weaker rock and shaping of product in one pass;

High throughput through the use of centrifugal force to 'force feed' compression crushing elements to allow them to operate at very high frequencies;

Arrested crushing processes limiting the maximum transit speed of rock particles to limit the coriolis forces produced. Rock travels through the rotor in a series of high acceleration, low maximum velocity steps. This limits the wear on metal components to levels similar to traditional gravitational compression crushers;

Improved energy efficiency, when compared to existing VSI crushers, through the recovery of previously wasted grinding energy. Forces developed on the feed material by virtue of the rotational motion serve to assist the reciprocating motion of the crushing elements, reducing the energy required to drive them;

The acceptance of a larger feed particle size than conventional autogenous VSI crushers;

Higher particle densities in the crushing chambers which improve the inter-particle crushing action, which results in higher reduction ratios and improved product shape in known fashion;

Less packing of feed material in crushing chambers due to the action of centrifugal force, which tends to clear the chambers of fine material produced by the crushing action, or initially present in the feed;

The use of nip angles in the compression crushing elements in excess of those possible for conventional gravitationally fed crushers due to the 'force feeding' action of centrifugal force. This allows high reduction ratios from relatively compact crushing elements;

Adjustability of the balance between compression and impact crushing processes via crushing element setting and frequency adjustments, and rotor speed adjustments; and Simplified crushing plant design where one machine performs functions previously requiring two machines. Plant re-circulating load and screening capacity requirements are also reduced.

The design concept, of optimum crushing frequency being largely dependant on the acceleration to which the rock particles are subjected to, in transit through the crushing chamber, is an important consideration in the operation of the proposed invention. Acceleration of the feed rock through the crushing chamber is typically greater than 150 times that due to gravity. This allows an increase in compression crushing frequency over that used in prior art compression crushing equipment. Frequencies can be increased by a factor equal to the square root of the acceleration increase; i.e. at least 1200%. This dramatically increases production capacity.

The use of an arresting crushing process to limit the Vr attained by the feed rock to a relatively low value is advantageous for VSI rotor life. If the mechanism is one by which the energy available internally within the rotor (due to the rocks' travel from centre to rim) is applied efficiently to advantageous crushing processes its benefit is further maximised. The present invention is one by which both these objectives are achieved: Coriolis force rotor and tip abrasion is minimised while energy lost to internal friction is also minimised.

Aspects of the present invention have been described by way of example only and it should be appreciated that modifications and additions may be made thereto without departing from the scope thereof as defined in the appended claims

What I claim is:

1. A rock crushing apparatus comprising:

a rotor, comprising:

a number of compression crushing elements positioned on an interior surface of the rotor;

a reciprocating means configured to drive a reciprocating portion of each compression crushing element to compression crush rock;

and wherein in use, with the rotor rotating, rock passing through the rotor is arrested by the reciprocating portion, thereby limiting the maximum radial velocity (Vr) the rock attains in the rotor before ejection from the rotor for impact crushing on an adjacent surface.

2. A rock crushing apparatus as claimed in claim 1, wherein the compression crushing elements are jaw compression crushing elements.

3. A rock crushing apparatus as claimed in claim 1, wherein each compression crushing element also comprises a fixed portion.

4. A rock crushing apparatus as claimed in claim 3, wherein the fixed portion comprises a leading edge and a trailing edge with respect to the direction of rotation of the rotor.

5. A rock crushing apparatus as claimed in claim 3, wherein each compression crushing element also comprises an adjustment means to control a compression crushing element setting.

6. A rock crushing apparatus as claimed in claim 1, wherein the compression crushing elements are angled with respect to the direction of rotation of the rotor.

7. A rock crushing apparatus as claimed in claim 1, wherein the compression crushing elements are oriented so that they reciprocate in the same plane as the rotation of the rotor.

8. A rock crushing apparatus as claimed in claim 1, wherein the reciprocating portion is located on a trailing side of each compression crushing element with respect to a direction of rotation of the rotor.

9. A rock crushing apparatus as claimed in claim 1, further comprising a sub rotor for driving the reciprocating means.

10. A rock crushing apparatus as claimed in claim 1, wherein each reciprocating portion is adapted to be driven in a reciprocal motion by direct contact with a surface surrounding and external to the rotor.

11. A rock crushing apparatus as claimed in claim 1, wherein each reciprocating portion of each compression crushing element is orientated around a periphery of the rotor so that, in use, each reciprocating portion is subjected to a reactive force from rock flowing through the rotor to reduce the load on the compression crushing drive mechanism and thus improve the overall energy efficiency of the apparatus.

12. A rock crushing apparatus as claimed in claim 3, wherein there is an even number of alternating reciprocating portions and fixed portions equally spaced around a periphery of the rotor.

13. A rock crushing apparatus as claimed in claim 12, wherein rock passing between a channel formed between an adjacent fixed portion and reciprocating portion is compression crushed.

14. A rock crushing apparatus as claimed in claim 1, wherein the compression crushing elements are positioned in pairs diametrically opposed to each other and timed to reciprocate identically to each other.

15. A rock crushing apparatus as claimed in claim 14, wherein the compression crushing action of each pair of compression crushing elements is timed differently from the other pairs of compression crushing elements so as to even the loading on the compression crushing drive mechanism.

16. A rock crushing apparatus as claimed in claim 1, wherein the rotor is configured to allow the compression crushing elements to perform their compression crushing action while the rotor is being driven in either direction of rotation.

17. A rock crushing apparatus as claimed in claim 1, wherein the adjacent surface is a rock bed surrounding the rotor.

18. A rock crushing apparatus as claimed in claim 1, wherein the crushing apparatus also comprises a rotor drive taking power from an attached power source, to create rotational motion of the rotor up to the desired tip speed.

19. A rock crushing apparatus as claimed in claim 9, further comprising:

a power supply configured to power a sun gear of the sub rotor for driving the reciprocating means such that each reciprocating portion is driveable at a frequency independent of a rotating speed of the rotor.

20. A rock crushing apparatus as claimed in claim 18, wherein the crushing apparatus also comprises an attaching means configured to attach the rotor to the rotor drive so that the rotor may be easily removed for maintenance.

21. A method of crushing rock, comprising the steps of:

i) feeding rock into a rotor of a rock crushing apparatus;

ii) driving a reciprocating means of the apparatus configured to drive a reciprocating portion of a number of compression crushing elements for compression crushing the rock;

iii) arresting the rock passing through the rotor with the reciprocating portions, thereby limiting the maximum radial velocity (Vr) the rock attains in the rotor before ejection from the rotor; and iv) impact crushing the ejected rock on an adjacent surface to the rotor.

* * * * *